US012703542B2

(12) United States Patent
Owen

(10) Patent No.: US 12,703,542 B2
(45) Date of Patent: Aug. 11, 2026

(54) CLOSURE AND PACKAGE WITH CLOSURE

(71) Applicant: Closure Systems International Inc., Indianapolis, IN (US)

(72) Inventor: Robert H. Owen, Crawfordsville, IN (US)

(73) Assignee: CLOSURE SYSTEMS INTERNATIONAL INC., Indianapolis, IN (US)

( * ) Notice: Subject to any disclaimer, the term of this patent is extended or adjusted under 35 U.S.C. 154(b) by 36 days.

(21) Appl. No.: 18/810,916

(22) Filed: Aug. 21, 2024

(65) Prior Publication Data

US 2025/0074663 A1 Mar. 6, 2025

Related U.S. Application Data

(60) Provisional application No. 63/580,645, filed on Sep. 5, 2023.

(51) Int. Cl.
*B65D 41/34* (2006.01)
*B65D 41/04* (2006.01)

(52) U.S. Cl.
CPC ..... *B65D 41/3404* (2013.01); *B65D 41/0414* (2013.01); *B65D 2215/02* (2013.01)

(58) Field of Classification Search
CPC ..... B65D 2401/15; B65D 41/3404; B65D 41/0442; B65D 41/0414; B65D 2215/02; B65D 50/041
See application file for complete search history.

(56) References Cited

U.S. PATENT DOCUMENTS

| | | | | |
|---|---|---|---|---|
| 4,011,960 A * | 3/1977 | Mauvernay | B65D 50/041 215/220 |
| 4,673,095 A * | 6/1987 | Puresevic | B65D 50/041 215/220 |
| 2022/0281658 A1* | 9/2022 | Angelozzi | B65D 47/063 |
| 2023/0406582 A1* | 12/2023 | Bois | B65D 41/005 |

* cited by examiner

*Primary Examiner* — Shawn M Braden
(74) *Attorney, Agent, or Firm* — NIXON PEABODY LLP

(57) ABSTRACT

A polymeric closure assembly includes inner and outer shells. The inner shell includes a top wall portion and a skirt portion. The top wall portion of the inner shell forms a recess and includes ratchet teeth. The outer shell includes a top wall portion and a skirt portion. The top wall portion of the outer shell includes inner and outer portions. The outer portion of the outer shell is detachably connected to the inner portion of the outer shell by frangible connections. The top wall portion of the outer shell includes a retention projection and ratchet teeth. The retention projection is received and contained within the recess to assist in engaging the inner and outer shells after breaking of the frangible connections. The ratchet teeth of the inner and outer shells cooperate to assist in providing torque transfer to assist in threading the polymeric closure assembly and the container.

20 Claims, 10 Drawing Sheets

CLOSURE AND PACKAGE WITH CLOSURE

CROSS-REFERENCE TO RELATED APPLICATION

This application claims priority to and benefit of U.S. Provisional Patent Application No. 63/580,645 filed Sep. 5, 2023, which is hereby incorporated by reference herein in its entirety.

FIELD OF THE INVENTION

The present invention relates generally to a closure assembly and a package with a closure assembly. More specifically, the present invention relates to a polymeric closure assembly with tamper-evident and child-resistance features.

BACKGROUND OF THE INVENTION

Polymeric closures have been used in many applications over the years in conjunction with containers. One type of polymeric closure that has been used with containers is a tamper-evident polymeric closure. Tamper-evident closures are used to prevent or inhibit tampering by providing a visible indication to a user if the closure has been opened. In some embodiments, an induction foil seal is used to create a tamper-evident feature. An induction foil seal is often used in over the counter (OTC) products.

One drawback to these products is in the manufacturing process where an additional component (the induction foil seal) needs to be procured, tested, stored and assimilated into the production process, which adds costs, time and resource allocation to the product. In a one-time usage, the foil seal is either removed by tearing or cutting through the same to access the product in the container. This requires a user to discard the foil seal or push the foil seal into the container, which could contaminate the product. If the foil seal remains (or a portion thereof), this will likely disrupt the recycling process of the consumed product package.

It would be desirable to provide a closure assembly that replaces the tamper-evident feature of an induction foil seal, while producing recyclability advantages on the same.

SUMMARY

According to one aspect of the present disclosure, a polymeric closure assembly includes a polymeric inner shell and a polymeric outer shell. The polymeric inner shell includes a polymeric top wall portion and a polymeric annular skirt portion. The polymeric annular skirt portion of the inner shell depends from the polymeric top wall portion of the inner shell. The polymeric top wall portion of the inner shell includes an exterior surface and an interior surface. The exterior surface of the polymeric top wall portion of the inner shell forms a recess and includes a plurality of ratchet teeth. The polymeric annular skirt portion of the inner shell includes an exterior surface and an interior surface. The interior surface of the polymeric annular skirt portion of the inner shell includes a thread formation for mating engagement with a thread formation of a container. The polymeric outer shell includes a polymeric top wall portion and a polymeric annular skirt portion. The polymeric annular skirt portion of the outer shell depends from the polymeric top wall portion of the outer shell. The polymeric top wall portion of the outer shell includes an inner portion and an outer portion. The outer portion of the outer shell is detachably connected to the inner portion of the outer shell by a plurality of frangible connections. The inner portion of the polymeric top wall portion of the outer shell includes an exterior surface and an interior surface. The interior surface of the inner portion of the polymeric top wall portion of the outer shell includes a retention projection and a plurality of ratchet teeth. The retention projection is configured to be received and contained within the recess formed in the inner shell to assist in engaging the inner and outer shells after breaking of the plurality of frangible connections. The plurality of ratchet teeth of the inner shell and the plurality of ratchet teeth of the outer shell cooperate to assist in providing torque transfer to assist in threading the polymeric closure assembly and the container.

According to a configuration of the above implementation, the recess formed in the polymeric top wall portion of the inner shell includes a continuous annular ring. The continuous annular ring assists in containing the retention portion within the recess formed in the polymeric top wall portion of the inner shell after breaking of the plurality of frangible connections. The retention projection may include a plurality of deflectable portions. The plurality of deflectable portions and the continuous annular ring assist in containing the inner portion of the outer shell within the recess after breaking of the plurality of frangible connections.

According to another configuration of the above implementation, the thread formation of the inner shell is an internal thread formation for mating engagement with an external thread formation of a container.

According to a further configuration of the above implementation, the interior surface of the polymeric top wall portion of the outer shell includes a plurality of torque-transfer ribs. The exterior surface of the polymeric top wall portion of the inner shell includes a plurality of torque-transfer extending projections. The plurality of torque-transfer ribs and the plurality of torque-transfer extending projections cooperate to form a child-resistant feature by preventing or inhibiting opening of the container by only rotational movement.

In a further aspect of the above implementation, each of the plurality of torque-transfer extending projections has a generally straight side and an opposing ramped side.

In a further aspect of the above implementation, the outer portion of the outer shell includes a spacer ring. The spacer ring connects with the inner portion of the outer shell via the plurality of frangible connections.

In yet a further aspect of the above implementation, the inner portion of the outer shell is an inner ring, and the outer portion of the outer shell is an outer ring.

In yet a further aspect of the above implementation, the inner portion of the outer shell is recessed relative to the outer portion of the outer shell.

In yet a further aspect of the above implementation, each of the ratchet teeth of the outer shell increases in thickness from one end to a second end and forms a ramp. Each of the ratchet teeth of the inner shell increases thickness from one end to a second end and forms a ramp.

In another aspect of the above implementation, the inner shell has an inner portion and an outer portion separated by a continuous annular channel formed therebetween. The continuous annular channel is configured to receive a section of the outer portion of the outer shell after the plurality of frangible connections is broken.

According to a configuration of the above implementation, the polymeric annular skirt portion of the outer shell includes an inwardly annular retention ring at a bottom thereof to assist in retaining the inner and outer shells together.

According to a configuration of the above implementation, the outer shell further includes a centering ring. The centering ring extends inwardly from an interior surface of the polymeric annular skirt portion of the outer shell.

According to another aspect of the present disclosure, a package includes a container and a polymeric closure assembly. The container has a neck portion defining an opening. The neck portion has an exterior surface and an interior surface. The container has a thread formation being located on the exterior surface of the neck portion. The polymeric closure assembly is configured for fitment to the neck portion of the container. The polymeric closure assembly includes a polymeric inner shell and a polymeric outer shell. The polymeric inner shell includes a polymeric top wall portion and a polymeric annular skirt portion. The polymeric annular skirt portion of the inner shell depends from the polymeric top wall portion of the inner shell. The polymeric top wall portion of the inner shell includes an exterior surface and an interior surface. The exterior surface of the polymeric top wall portion of the inner shell forms a recess and includes a plurality of ratchet teeth. The polymeric annular skirt portion of the inner shell includes an exterior surface and an interior surface. The interior surface of the polymeric annular skirt portion of the inner shell includes a thread formation for mating engagement with the thread formation of the container. The polymeric outer shell includes a polymeric top wall portion and a polymeric annular skirt portion. The polymeric annular skirt portion of the outer shell depends from the polymeric top wall portion of the outer shell. The polymeric top wall portion of the outer shell includes an inner portion and an outer portion. The outer portion of the outer shell is detachably connected to the inner portion of the outer shell by a plurality of frangible connections. The inner portion of the polymeric top wall portion of the outer shell includes an exterior surface and an interior surface. The interior surface of the inner portion of the polymeric top wall portion of the outer shell includes a retention projection and a plurality of ratchet teeth. The retention projection is configured to be received and contained within the recess formed in the inner shell to assist in engaging the inner and outer shells after breaking of the plurality of frangible connections. The plurality of ratchet teeth of the inner shell and the plurality of ratchet teeth of the outer shell cooperate to assist in providing torque transfer to assist in threading the polymeric closure assembly and the container.

According to a further configuration of the above implementation, the recess formed in the polymeric top wall portion of the inner shell includes a continuous annular ring. The continuous annular ring assists in containing the retention portion within the recess formed in the polymeric top wall portion of the inner shell after breaking of the plurality of frangible connections.

In a further aspect of the above implementation, the interior surface of the polymeric top wall portion of the outer shell includes a plurality of torque-transfer ribs. The exterior surface of the polymeric top wall portion of the inner shell includes a plurality of torque-transfer extending projections. The plurality of torque-transfer ribs and the plurality of torque-transfer extending projections cooperate to form a child-resistant feature by preventing or inhibiting opening of the container by only rotational movement.

In a further aspect of the above implementation, the outer portion of the outer shell includes a spacer ring. The spacer ring connects with the inner portion of the outer shell via the plurality of frangible connections.

In yet a further aspect of the above implementation, the inner portion of the outer shell is recessed relative to the outer portion of the outer shell.

In yet a further aspect of the above implementation, each of the ratchet teeth of the outer shell increases thickness from one end to a second end and forms a ramp. Each of the ratchet teeth of the inner shell increases in thickness from one end to a second end and forms a ramp In yet a further aspect of the above implementation, the inner shell has an inner portion and an outer portion separated by a continuous annular channel formed therebetween. The continuous annular channel is configured to receive a section of the outer portion of the outer shell after the plurality of frangible connections is broken.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
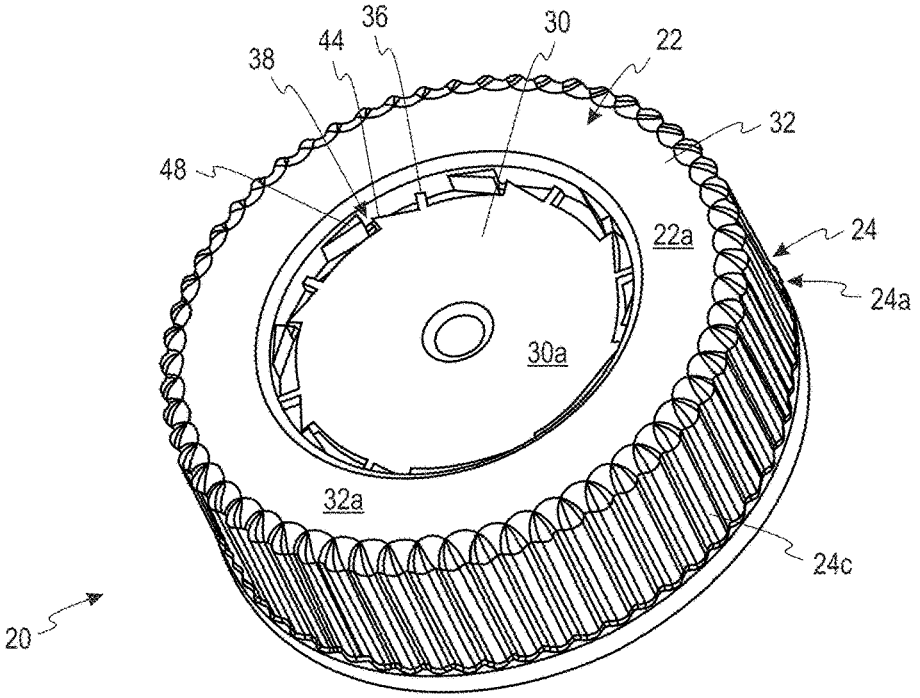
FIG. 1A is a top perspective view of a polymeric outer shell to be used in a closure assembly according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 1B:
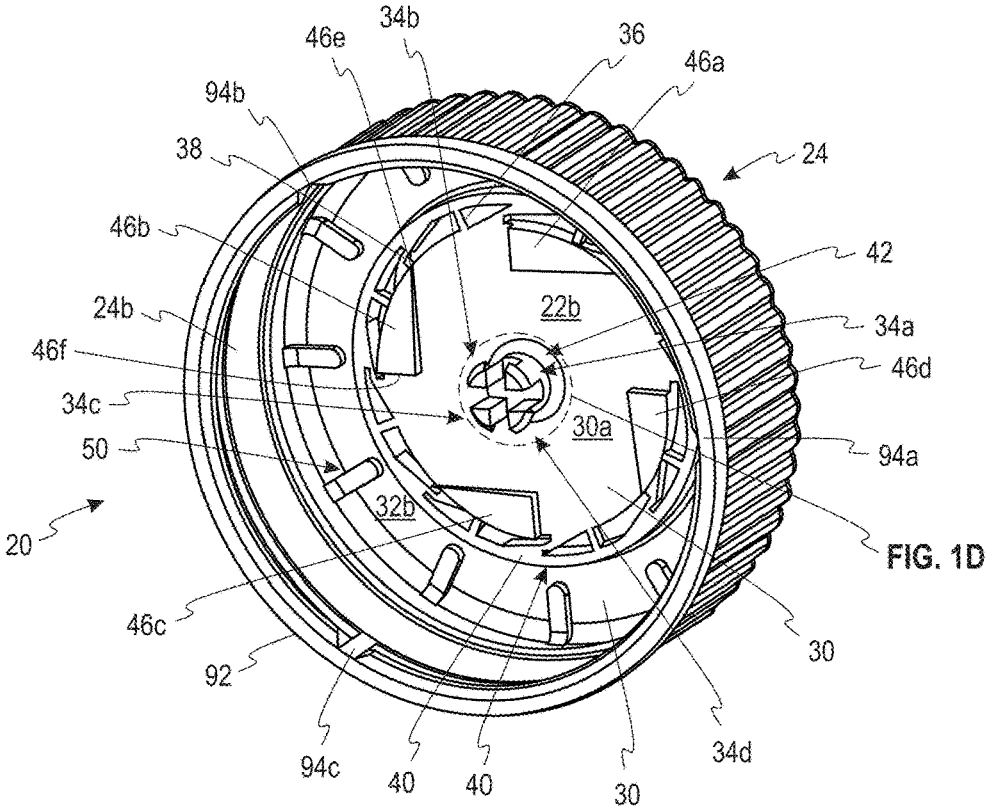
FIG. 1B is a bottom perspective view of the outer shell of FIG. 1A.
Figure 1C:
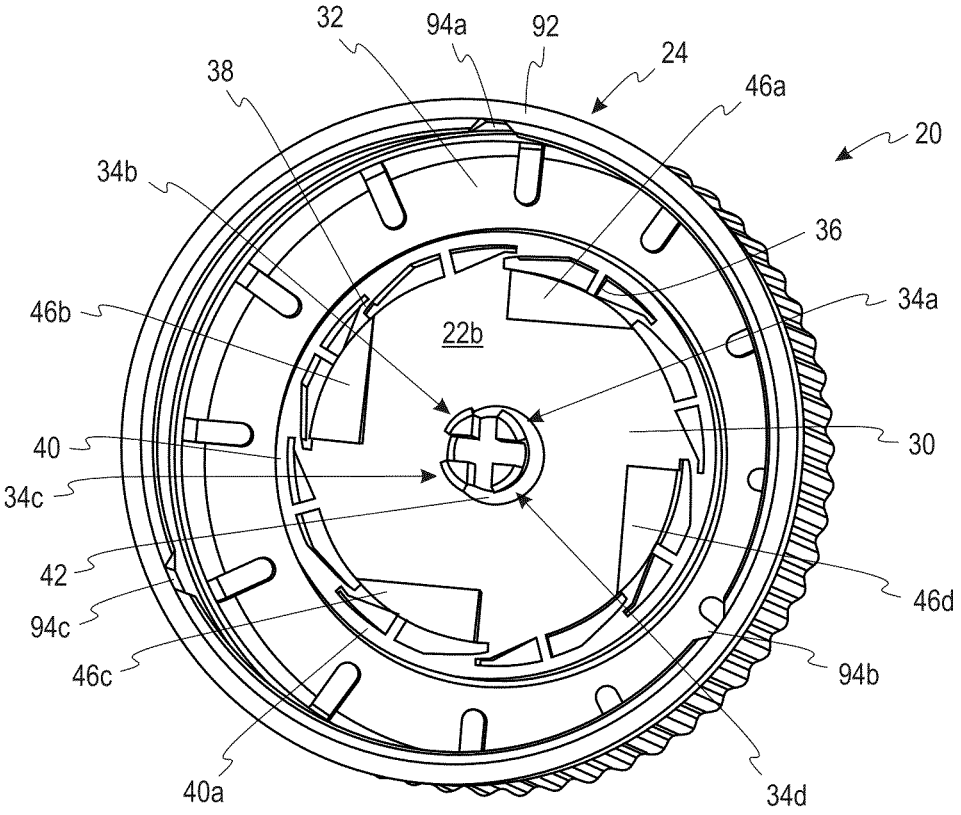
FIG. 1C is another bottom view of the outer shell of FIG. 1A.
Figure 2:
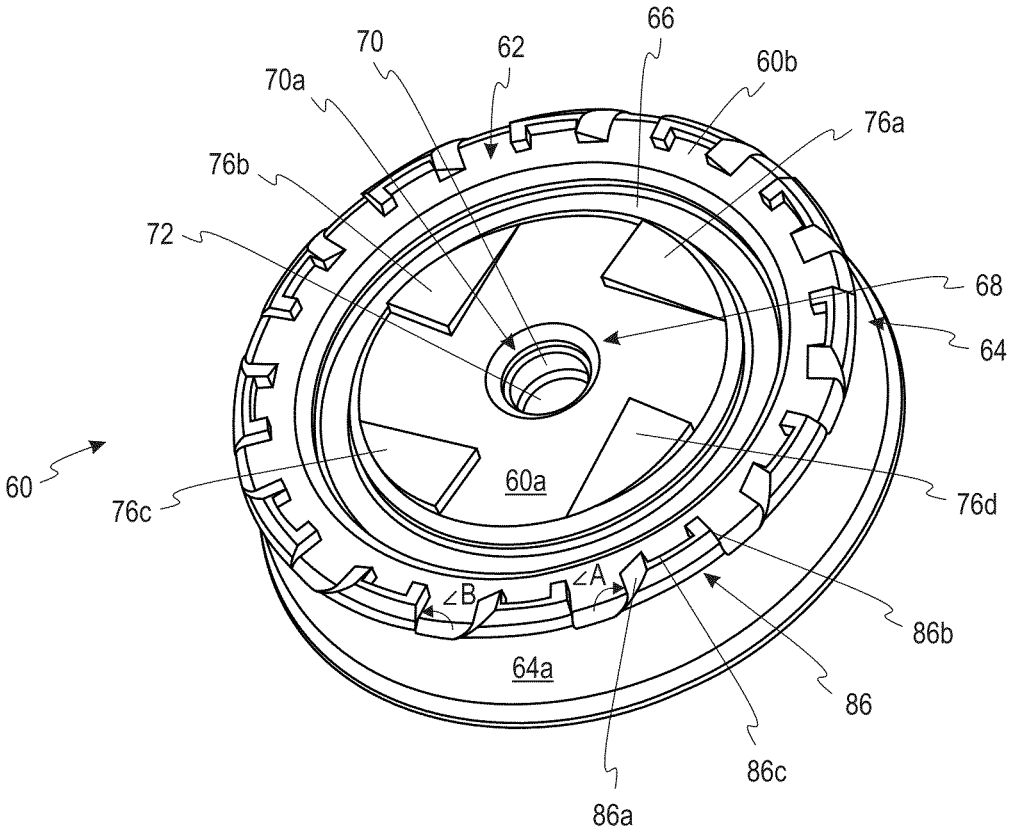
FIG. 2 is a top perspective view of a polymeric inner shell to be used in a closure assembly according to one embodiment.
Figure 5:
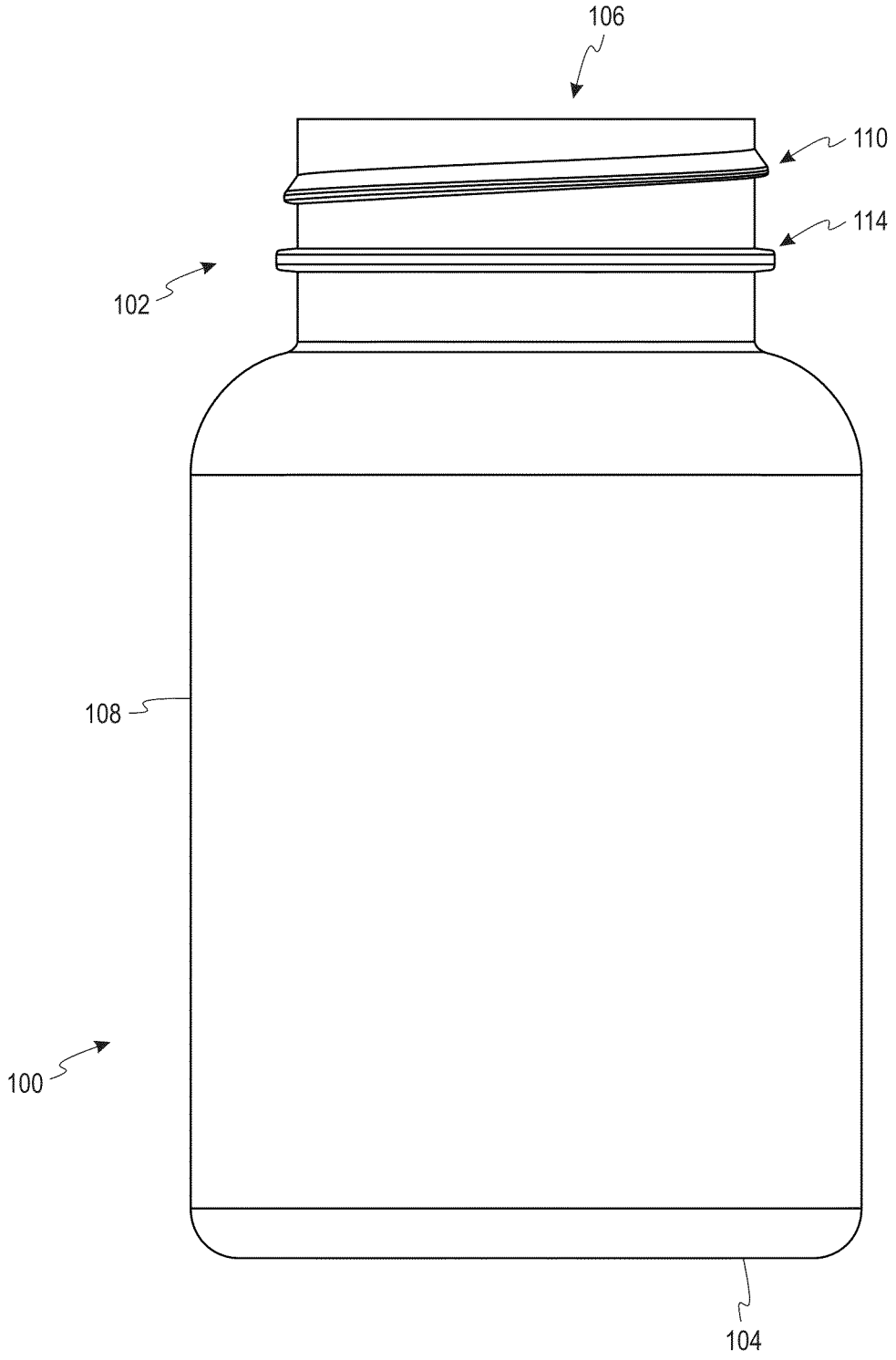
FIG. 5 is a side view of a container according to one embodiment.
Figure 6A:
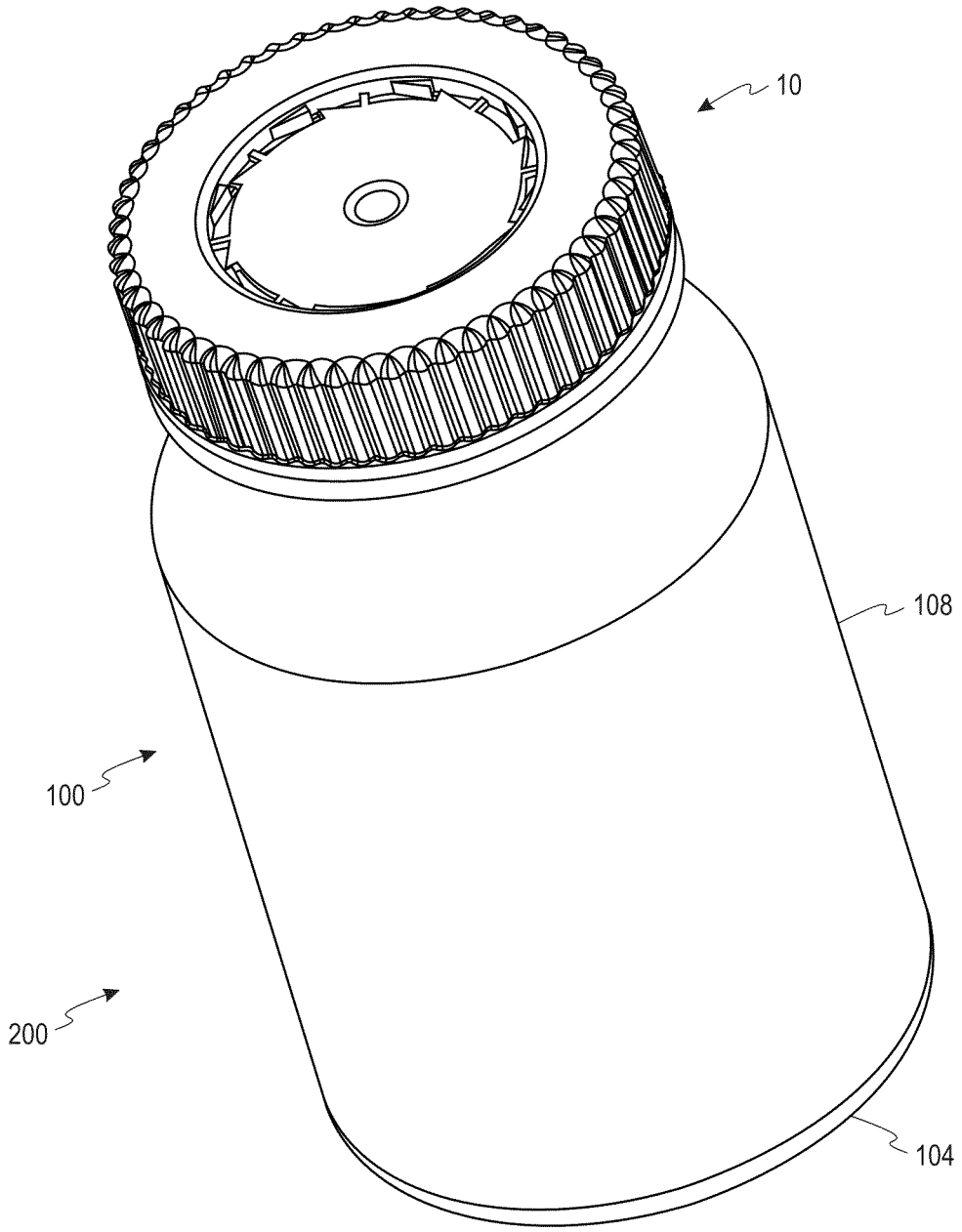
FIG. 6A is a top perspective view of the container of FIG. 5A with the container assembly of FIGS. 3A-3C.
Figure 6B:
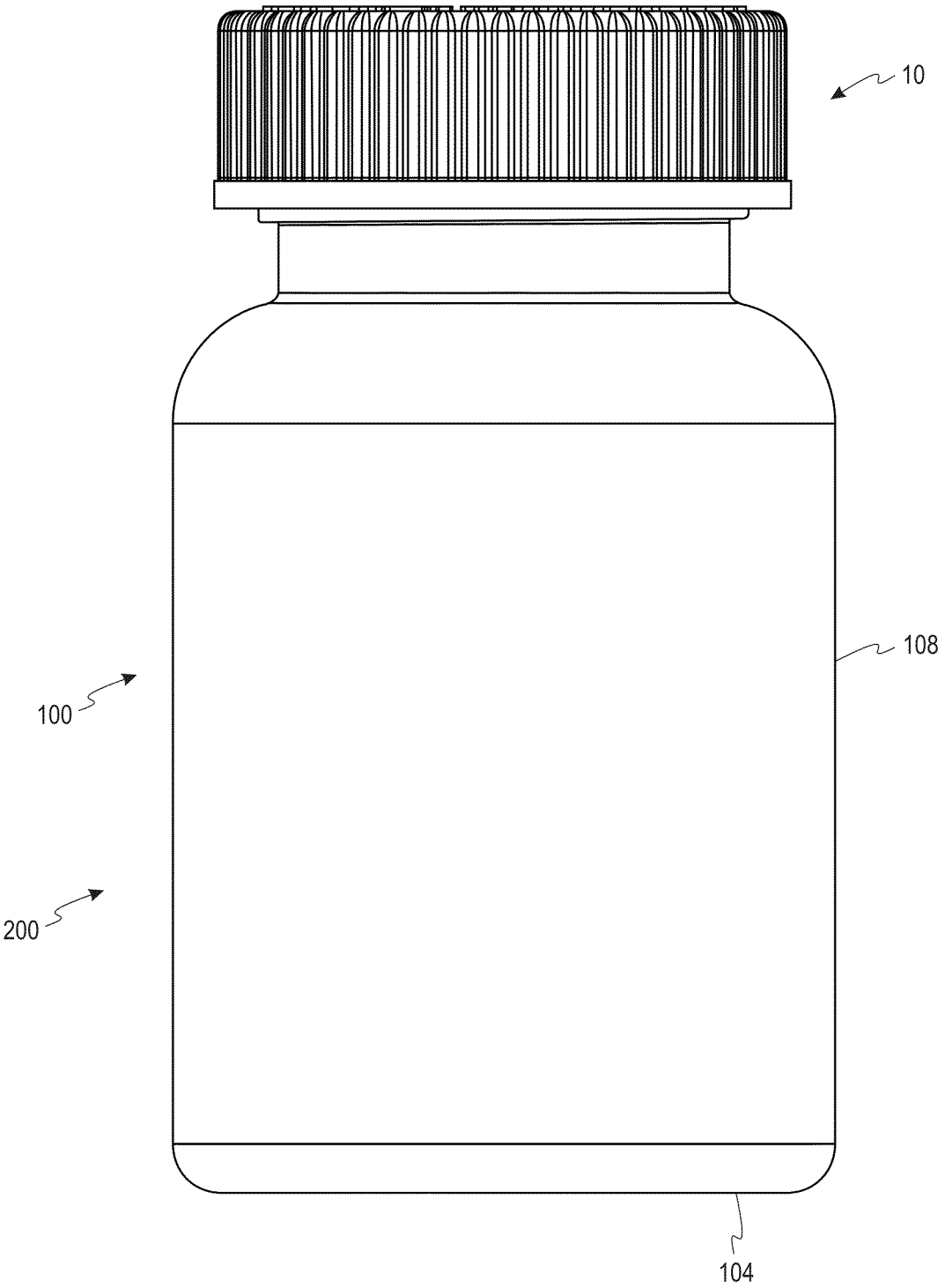
FIG. 6B is a side view of the container of FIG. 6A.

Referring to FIGS. 3A-3C, 4A, 4B, a polymeric closure assembly 10 according to one embodiment is shown. The polymeric closure assembly 10 includes a polymeric outer shell 20 and a polymeric inner shell 60. The outer shell 20 is shown in FIGS. 1A-1C, while the inner shell 60 is shown in FIG. 2. The polymeric closure assembly 10 is configured to be used with a container 100 that is shown in FIG. 5. Specifically, the polymeric closure assembly 10 is configured for fitment to the neck portion of the container 100 for closing and opening of the container. The polymeric closure assembly 10 and the container 100 form a package 200 that is shown in FIGS. 6A, 6B.

The polymeric closure assemblies of the present invention are advantageous since they eliminate the need for including an induction foil seal. This reduces an additional component (the induction foil seal) that needs to be procured, tested, stored and assimilated into the production process, which adds costs, time and resource allocation to the product. The polymeric closure assemblies of the present invention are also advantageous from a recyclability standpoint in that the closure assembly is typically made from one material, if desired. This makes recycling easier by eliminating potential containments from the foil, adhesives, pulp or other components of the induction foil seal.

Referring back to FIGS. 1A-1C, the polymeric outer shell 20 includes a polymeric top wall portion 22 and a polymeric annular skirt portion 24. The polymeric annular skirt portion 24 depends from the polymeric top wall portion 22. The polymeric top wall portion 22 has an exterior surface 22*a* and an interior surface 22*b*. The polymeric annular skirt portion 24 has an exterior surface 24*a* and an interior surface 24*b*.

The polymeric top wall portion 22 includes an inner portion 30 and an outer portion 32. The inner portion 30 is detachably connected to the outer portion 32 by a plurality of frangible connections 36, 38. More specifically, the plurality of frangible connections 36, 38 detachably connects to a spacer ring 40 that is formed in the outer portion 32. A surface 40*a* of the spacer ring 40 is substantially flush or flush with the inner portion 30 of the polymeric outer shell 20 in one embodiment. The spacer ring 40 assists in transferring torque from the polymeric outer shell 20 to the polymeric inner shell 60. As will be discussed below, the spacer ring 40 also assists in providing sufficient spacing between the tamper-evident features (torque-transfer ribs and torque-transfer extending projections) before the frangible connections are broken.

The inner portion 30 of the outer shell 20 has an exterior surface 30*a* and an interior surface 30*b*. In this embodiment the inner portion 30 of the outer shell 20 is in the form of an inner ring. The outer portion 32 of the outer shell 20 has an exterior surface 32*a* and an interior surface 32*b*. In this embodiment the outer portion 32 of the outer shell 20 is in the form of an outer ring or a doughnut. The exterior surface 30*a* of the inner portion 30 of the outer shell 20 is recessed downwardly (in the direction of arrow B in FIGS. 4A, 4B) from the exterior surface 32*a* of the outer portion 32 of the outer shell 30. The recessing of the inner portion 30 assists in providing and aligning the spacer ring and its functionality.

The plurality of frangible connections 36, 38 are formed along a periphery or circumference of the inner portion 30 of the polymeric outer shell 20. The frangible connections 36, 38 form the tamper-evident feature in the polymeric closure assembly 10. The frangible connections 36, 38, when broken, indicate to a user that the contents of the container 100 may have been accessed. Thus, the frangible connections 36, 38 provide tamper evidency. More specifically, the frangible connections 36, 38 are designed to fully separate the inner portion 30 and the outer portion 32 of the polymeric top wall portion 22, which begins the process of a user opening the package 200.

The frangible connections 36, 38 may be formed by molded-in-bridges in one embodiment. In this embodiment, the molded-in-bridges are formed using a feature in the mold. The frangible connections 36, 38 are in the form of scoring or scored lines, notches, leaders, nicks or other lines of weaknesses. It is contemplated that the frangible connections may be formed in other manners than in the polymeric closure assembly of FIGS. 1A-1C. These frangible connections, however, need to remain intact during the manufacturing process and, more specifically, during the placing of the polymeric closure assembly onto the container.

In another method, the frangible connections may be formed by compression molding and subsequent slitting.

The plurality of frangible connections 36 is generally a straight line extending between the inner portion 30 and the outer portion 32 of the polymeric top wall portion 22. The frangible connections 36 assist in selected manufacturing process by assisting in the polymeric material flow to other areas of the polymeric outer shell 20. The frangible connections 36 are under tension. These frangible connections may vary in number, but are generally from about 3 to about 15 and, more specifically, from about 6 to about 12 or from about 6 to about 10.

The frangible connections 38 are stronger structures than the frangible connections 36. The frangible connections 38 are of sufficient strength such that they will remain unbroken when the polymeric closure assembly 10 is being located initially on the container 100 to form the package 200 in the manufacturing process. Thus, the strength of the frangible connections 38 needs to be greater than the torque involved in threading or placing the polymeric closure assembly 10 onto the container 100 to form the package 200. The frangible connections 38 are formed and positioned by the assistance of corresponding plurality of wedges 48. The plurality of wedges 48 assists in the manufacturing process and assist in orientating the frangible connections 38.

The frangible connections 38 assist in transferring the torque from the outer portion 32 of the polymeric outer shell 20 to the inner portion 30 of the polymeric outer shell 20 and eventually to the polymeric inner shell 60. Saw-teeth 44 of the inner portion 30 assists in transferring the torque from the outer portion 32.

These frangible connection may vary in number, but are generally from about 3 to about 15 and, more specifically, from about 4 to about 12 or from about 6 to about 10.

It is contemplated that other frangible connections may be used than those depicted in FIGS. 1A-1C. These other frangible connections would need to have a higher strength than that involved in threading or placing the polymeric closure assembly onto the container to form the package.

Referring specifically to FIGS. 1B, 1C, the interior surface 22*b* of the polymeric outer shell 20 includes a retention projection 42, a plurality of ratchet teeth 46*a*-46*d*, and a plurality of torque-transfer ribs 50.

As will be discussed in detail below, the retention projection 42 is configured to be received by a recess 68 of the polymeric inner shell 60. The retention projection 42 desirably forms a snap fit with the recess 68 of the polymeric inner shell 60.

Figure 1D:
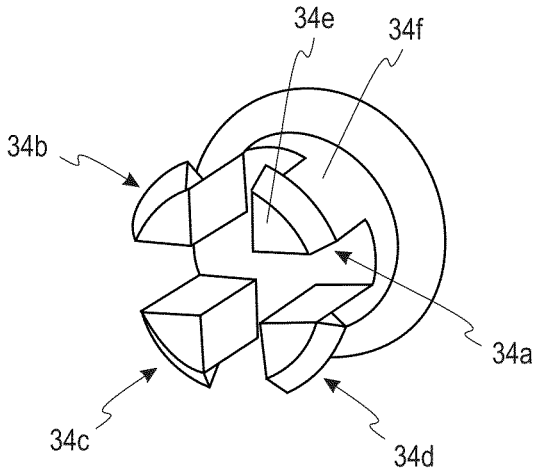
FIG. 1D is an enlarged view of a generally circular area FIG. 1D in FIG. 1B.

The retention projection 42 includes a plurality of deflectable portions 34*a*-34*d* (see FIGS. 1B-1D). Referring to FIG. 1D, each of the plurality of deflectable portions 34*a*-34*d* includes a stem and a deflectable, outwardly extending top portion. This is shown in FIG. 1D with the deflectable portion 34*a* including a stem 34*c* and a deflectable, outwardly extending top portion 34*f*. The stem 34*e* is encompassed and integrally connected with the deflectable, outwardly extending top portion 34*f*. The deflectable, outwardly extending top portion 34*f* extends further outwardly than the stem 34*e* to assist in preventing or inhibiting movement of the retention projection 42 of the polymeric outer shell 20 from the recess 68 of the polymeric inner shell 60.

In one embodiment, the number of deflectable portions of the retention projection is from about 2 to about 12. In another embodiment, the number of deflectable portions of the retention projection is from about 2 to about 8. In a further embodiment, the number of deflectable portions of the retention projection is from about 3 to about 6.

It is contemplated that other retention projections may be used to engage the polymeric inner and outer shells after breaking of the plurality of frangible connections so as to prevent or inhibit the polymeric inner and outer shells from being separated from each other.

The interior surface 22*b* of the polymeric top wall portion 22 forms the ratchet teeth 46*a*-46*d* as shown best in FIG. 1B. The ratchet teeth 46*a*-46*d* works in conjunction with the ratchet teeth 76*a*-76*d* of the polymeric inner shell to assist in torque transfer during the threading or placing of the polymeric closure assembly onto the container. The ratchet-teeth 46*a*-46*d* and the ratchet teeth 76*a*-76*d*, however, are not engageable to open the polymeric closure assembly 10, but assist in closing the polymeric closure assembly.

Each of the ratchet teeth 46*a*-46*d* is in the general shape of a half triangle. Each of the ratchet teeth 46*a*-46*d* has a first end 46*e* and a second end 46*f*. The thickness gradually increases in each of the ratchet teeth 46*a*-46*d* from the first end 46*e* to the second end 46*f*. This thickness is in the form of a gradually increasing ramp. This configuration assists in contacting the ratchet teeth 76*a*-76*d*.

The thickness of the ratchet teeth 46*a*-46*d* at the second end 46*f* is from about 0.01 inch to about 0.1 inch and, more specifically, from about 0.02 inch to about 0.5 inch.

In one embodiment, the number of ratchet teeth of the polymeric outer shell is from about 2 to about 10. In another embodiment, the number of ratchet teeth of the polymeric outer shell is from about 2 to about 8. In a further embodiment, the number of ratchet teeth of the polymeric outer shell is from about 3 to about 6.

The inner surface 22*b* of the polymeric top wall portion 22 of the polymeric outer shell 20 includes the plurality of torque-transfer ribs 50. The plurality of torque-transfer ribs 50 extends inwardly from or near the polymeric annular skirt portion 24. As will be discussed below, each of the torque-transfer ribs 50 is configured to engage with a respective one of the torque-transfer extending projections 86 to prevent or inhibit opening of the polymeric closure assembly to the container.

Referring back to FIGS. 1A, 1B, the exterior surface 24*a* of the polymeric annular skirt portion 24 includes a plurality of ridges or knurls 24*c* thereon. The plurality of ridges 24*c* assists a user in gripping the polymeric closure assembly 10 when moving between closed and open positions. It is contemplated that the ridges, if used, may be discontinuous around the periphery of the polymeric closure assembly.

Referring to FIG. 2, the polymeric inner shell 60 includes a polymeric top wall portion 62 and a polymeric annular skirt portion 64. The polymeric annular skirt portion 64 depends from the polymeric top wall portion 62. The polymeric annular skirt portion 64 includes an exterior surface 64*a* and an interior surface 64*b* (see FIGS. 4A, 4B).

The polymeric inner shell 60 has an outer portion 60*a* and an inner portion 60*b*. The outer and inner portions 60*a*, 60*b* are separated by a continuous annular channel 66 formed therebetween. As shown in FIG. 4B, the continuous annual channel 66 is sized and shaped to receive a section of the outer portion 32 of the polymeric top wall portion 22. By receiving a section of the outer portion 32 and seating the outer portion 32 in a desired and precise location after breaking of the frangible connections allows for the child-resistant feature to function properly by aligning the plurality of torque-transfer ribs 50 and the torque-transfer extending projections 86.

The polymeric top wall portion 62 of the polymeric inner shell 60 forms the recess 68 therein. The polymeric top wall portion 62 further includes a plurality of ratchet teeth 76*a*-76*d* and a plurality of torque-transfer extending projections 86. The polymeric annular skirt portion 64 includes a thread formation 80 (FIGS. 4A, 4B) wherein the thread formation of the polymeric inner shell 60 is an internal thread formation for mating engagement with an external thread formation of a container.

Figure 4A:
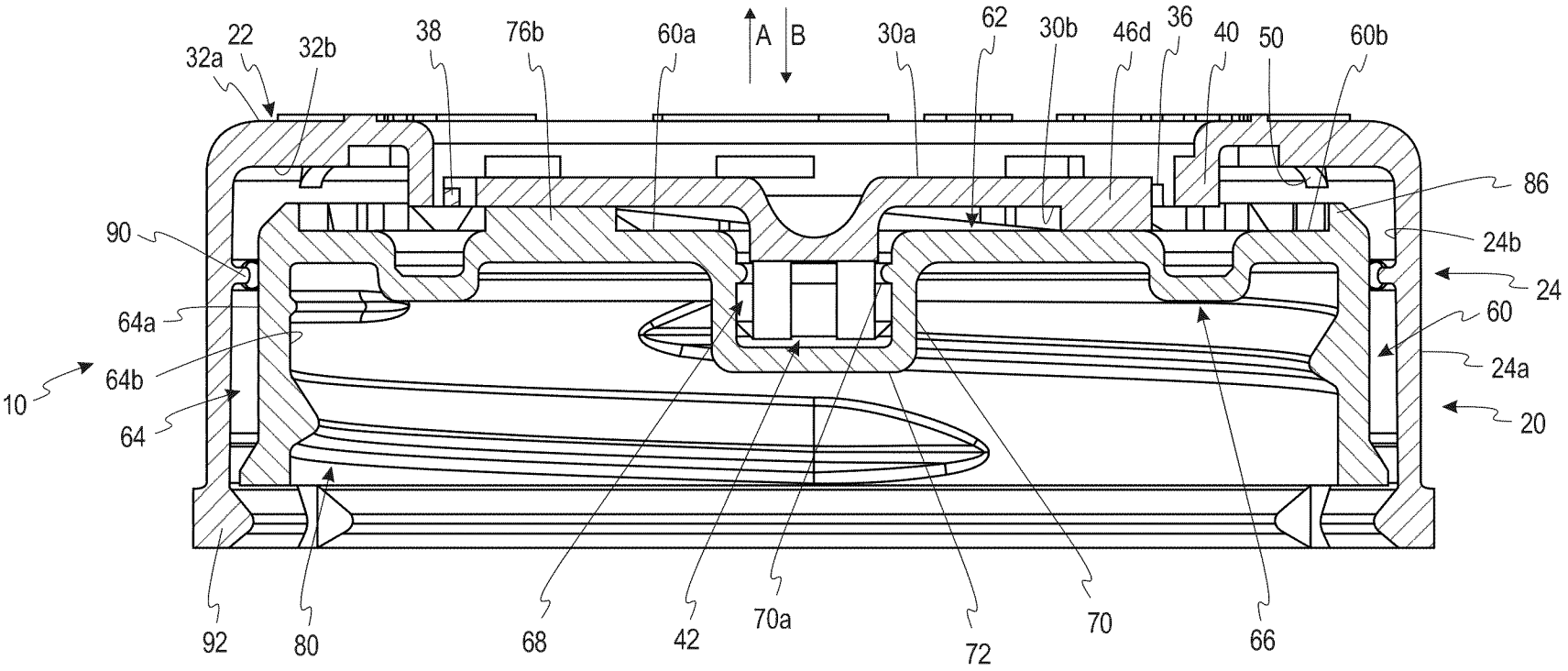
FIG. 4A is a cross-sectional view taken generally along the line 4A-4A of FIG. 3A of the polymeric closure assembly when the frangible connections are intact.
Figure 4B:
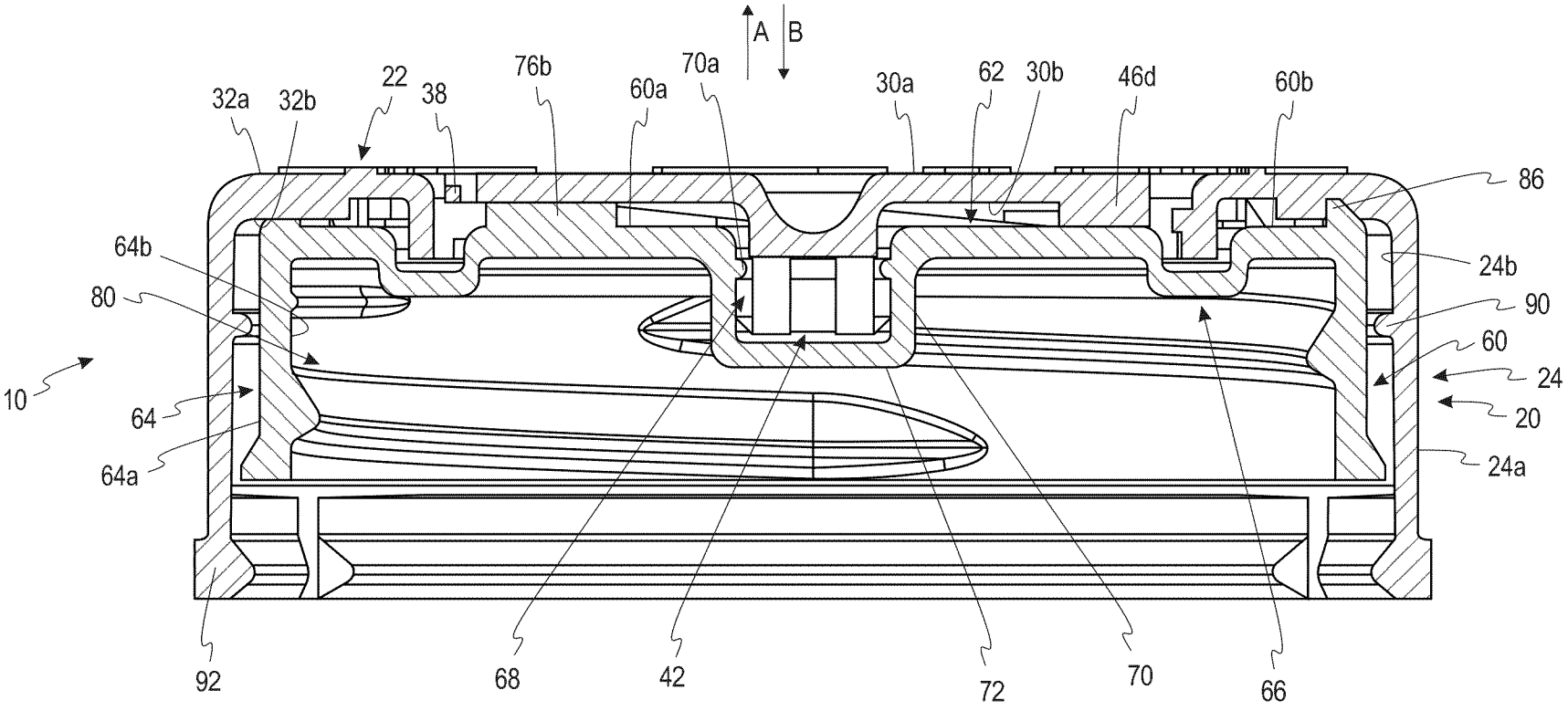
FIG. 4B is a cross-sectional view of FIG. 4A of the polymeric closure assembly when the frangible connections have been broken.

As shown in FIGS. 2, 4A, 4B, the recess 68 formed in the polymeric top wall portion 62 is formed by a continuous side wall 70 and a bottom wall 72 that encompasses and bridges the continuous side wall 70. The continuous sidewall 70 forms a continuous annular ring 70*a* that extends inwardly into the recess 68. In this embodiment, the recess 68 is centrally located in the polymeric top wall portion 62.

The continuous annular ring 70*a* assists in securing the polymeric outer shell 20 with the polymeric inner shell 60. This is beneficial in that the polymeric closure assembly 10 remains intact and can be recycled fully without having a portion of the polymeric closure assembly 10 being separated from the remainder of the polymeric container assembly.

More specifically, the continuous annular ring 70*a* assists in securing the inner portion 30 of the polymeric outer shell 20 to the polymeric inner shell 60 after the frangible connections 36, 38 have been broken.

The plurality of deflectable portions 34*a*-34*d* of FIG. 1D is configured to deflect inwardly toward the center of the retention projection 42 upon entering the recess 68 and contacting the continuous annular ring 70*a* of the polymeric inner shell 60. After the plurality of deflectable portions 34*a*-34*d* is moved further into the recess 68 of the polymeric inner shell 60 and pass the continuous annular ring 70*a* that extends into the recess 68 (in the direction of arrow B of FIGS. 4A, 4B), the plurality of deflectable portions 34*a*-34*d* returns to their initial outward position. The continuous annular ring 70*a* and plurality of deflectable portions 34*a*-34*d* assist in containing the inner portion of the polymeric outer shell 20 from leaving the recess 68.

The plurality of ratchet teeth 76*a*-76*d* is designed in a similar fashion as the plurality of ratchet teeth 46*a*-46*d* discussed above.

The plurality of ratchet teeth 46*a*-46*d* works in conjunction with the plurality of ratchet teeth 76*a*-76*d* of the polymeric inner shell to assist in torque transfer during the threading or placing of the polymeric closure assembly onto the container. The ratchet-teeth 46*a*-46*d* and the ratchet teeth 76*a*-76*d*, however, are not engageable to open the polymeric closure assembly 10, but assist in closing the polymeric closure assembly. The ratchet-teeth 46*a*-46*d* and the ratchet teeth 76*a*-76*d* are configured to slide over each other in one direction (counterclockwise) in this embodiment, but will not engage to open the polymeric closure assembly 10. The ratchet-teeth 46*a*-46*d* and the ratchet teeth 76*a*-76*d* are configured not to slide over each other in the other direction (clockwise) in this embodiment.

Referring to FIG. 2, the plurality of torque-transfer extending projections 86 is formed on the polymeric top wall portion 62 of the polymeric inner shell 60. The torque-transfer extending projections 86 is located near or at the edge of the polymeric top wall portion 62.

Each of the torque-transfer extending projections 86 has a ramped side 86*a* and a generally straight side 86*b*. The generally straight side 86*b* is perpendicular or generally perpendicular to the edge of the polymeric top wall portion 62. The ramped side 86*a* and the generally straight side 86*b* are located on opposing sides. Each of the torque-transfer extending projections 86 has a top surface 86*c* that bridges the ramped side 86*a* and the generally straight side 86*b*. The ramped side 86*a* is angled and generally has an angle A (as shown in FIG. 2) of from about 110 to about 160 degrees, and typically has an angle from about 120 to about 150 degrees. The generally straight side generally has an angle B (as shown in FIG. 2) of from about 75 to about 105 degrees, and typically has an angle from about 80 to about 100 degrees.

The plurality of torque-transfer extending projections 86 works in conjunction with the plurality of torque-transfer ribs 50 of the polymeric outer shell 20 to provide child resistance. It is noted that in the initial position (in which the frangible connections have not been broken) of FIG. 4A, the plurality of torque-transfer extending projections 86 of the polymeric inner shell 60 do not contact and are spaced from the plurality of torque-transfer ribs 50 of the polymeric outer shell 20.

After the frangible connections have been broken and a user presses axially (in the direction of arrow B in FIGS. 4A, 4B) on the outer portion 32 of the polymeric outer shell 20, the plurality of torque-transfer extending projections 86 of the polymeric inner shell 60 contact the plurality of torque-transfer ribs 50 of the polymeric outer shell 20 (see FIG. 4B). In one method, the user may press axially on the outer portion 32 of the polymeric outer shell 20 with a palm on the hand to break the frangible connections. After the frangible connections are broken, the outer portion 32 of the outer shell 20 seats into the recess 68 formed in the inner shell 60, which allows axial movement of the outer portion 32 of the outer shell 20 relative to the inner shell 60.

Specifically, after the frangible connections are broken, if a user in this embodiment turns the polymeric closure assembly 10 in a counterclockwise direction in an attempt to open the container and access the contents, the plurality of torque-transfer ribs 50 will initially ride up the ramped side 86*a* of the torque-transfer extending projections 86 and along the top surface 86*c* and then downwardly at the generally straight side 86*b*. During this movement in the counterclockwise direction, the thread formation 80 of the polymeric inner shell 60 will not mate or engage with the thread formation of a container. Thus, the container 100 will not be opened and will remain in a closed position with the polymeric closure assembly 10 without sufficient top loaded force. The container 100 will also not be opened by movement in the clockwise direction because of the generally straight side 86*b*.

To open the container 100 such that the thread formation 80 of the polymeric inner shell 60 engages with a corresponding thread formation of the container, a user must press in an axial, downward direction (direction of arrow B in FIGS. 4A, 4B) coupled with movement in a radially counterclockwise direction such that the thread formations of the polymeric inner shell and the container will engage with other, allowing the polymeric closure assembly 10 to unthread from the container 100.

Each of the plurality of torque-transfer extending projections 86 shown in FIG. 2 is in the shape of the letter "C". This shape of the torque-transfer extending projections 86 is designed to reduce the material costs associated therewith, while still providing the functionality of the torque-transfer projections.

It is contemplated that the torque-transfer projections may be shaped or sized differently from that shown in FIG. 2. The torque-transfer projections, however, need to assist in preventing or inhibiting opening or closing of the container by rotational movement only in conjunction with the torque-transfer ribs.

The number of torque-transfer projections formed on the polymeric top wall portion may vary but is generally from about 4 to about 20. The number of torque-transfer projections formed on the polymeric top wall portion is typically from about 8 to about 16.

Referring to FIGS. 4A, 4B, the polymeric outer shell 20 also includes a centering ring 90. The centering ring 90 extends inwardly from the interior surface 24*b* of the polymeric outer shell 90. The centering ring 90 assists in positioning the polymeric inner shell 60 with respect to the polymeric outer shell 20 in the manufacturing process. The centering ring 90 also assists in maintaining the positioning of the polymeric inner shell 60 with respect to the polymeric outer shell 20 in the manufacturing process.

Referring back to FIGS. 1B, 1C, the interior surface 24*b* of the polymeric annular skirt portion 24 includes an inwardly extending annular retention ring or ledge 92 at a bottom portion thereof. The inwardly extending retention ledge 92 is located opposite from the polymeric top wall portion 22 of the outer shell 20. The inwardly extending retention ring 92 assists in retaining the polymeric outer and inner shells 20, 60 together before and after the breakage of the frangible connections. The inwardly extending retention ring 92 includes a plurality of undercut notches 94*a*-94*c* that assists in the manufacturing process. More specifically, the plurality of undercut notches 94*a*-94*c* assists in releasing the outer shell 20 from a mold when the outer shell is made by a molding process (e.g., injection molding).

Referring specifically to FIGS. 4A, 4B, the polymeric annular skirt portion 64 of the polymeric inner shell 60 includes an internal thread formation 80 for mating engagement with an external thread formation of the container 100. The internal thread formation 80 is located on the interior surface 64*b* of the polymeric annular skirt portion 64. The internal thread formation 80 is one continuous helical thread in this embodiment. It is contemplated that the internal helical thread formation may be discontinuous.

In another embodiment, the internal thread formation of a polymeric annular skirt portion of a polymeric inner shell includes a first closure lead and a second closure lead, which are referred collectively as a double lead closure thread. Each of the first and second closure leads may be continuous. The first and second helical closure leads may be helical. The first positions of the first and second closure leads are often located roughly 180 degrees apart from each other and, thus, begin on generally opposing sides of the polymeric inner shell. It is contemplated that the first and second closure leads may be discontinuous.

It is also contemplated that the internal thread formation of the polymeric inner shell may differ from a helical thread formation. It is also contemplated that other internal thread formations may be used in the polymeric inner shell. For example, the internal thread formation may include a triple-threaded structure having first, second and third closure leads.

Figure 3A:
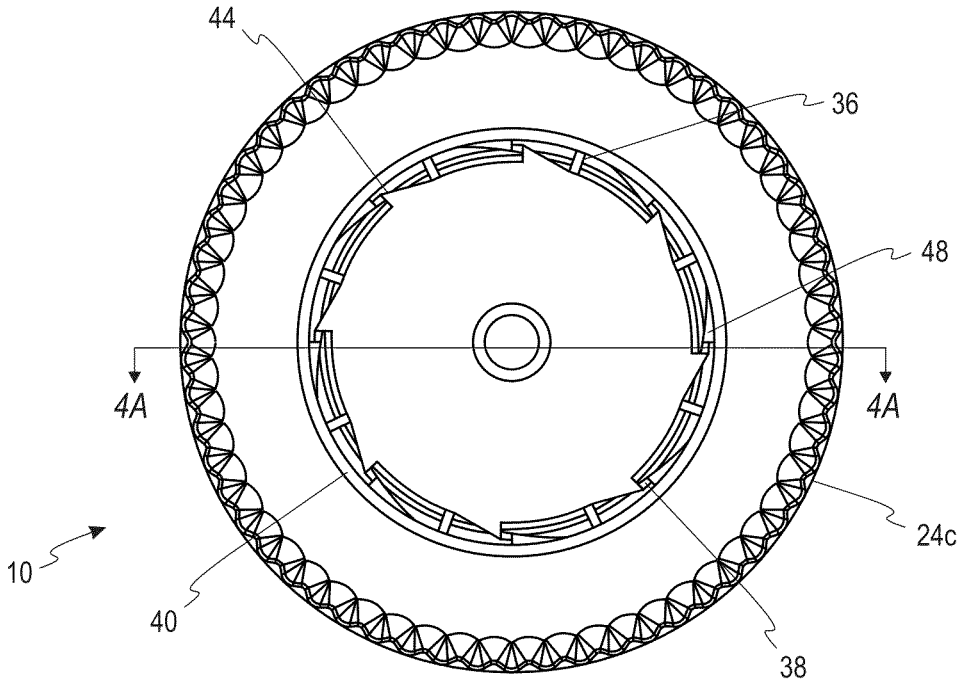
FIG. 3A is a top view of a polymeric closure assembly using the polymeric outer shell of FIG. 1A and the polymeric inner shell of FIG. 2 according to one embodiment.
Figure 3B:
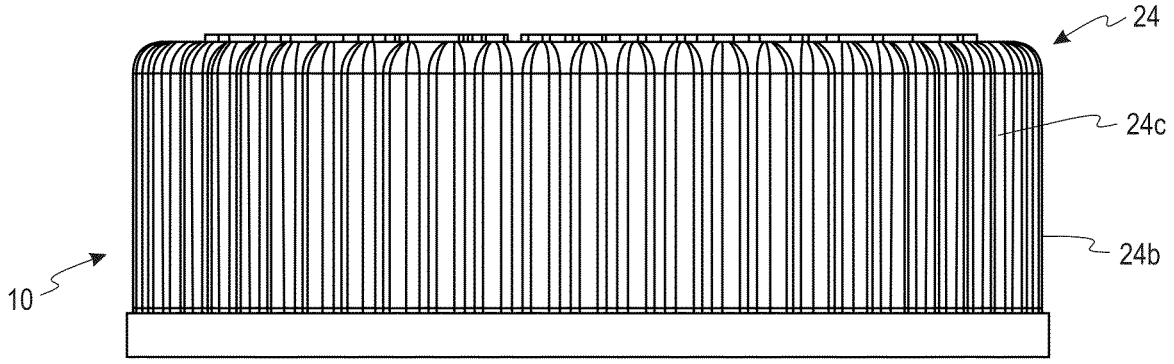
FIG. 3B is a side view of the polymeric closure assembly of FIG. 3A.
Figure 3C:
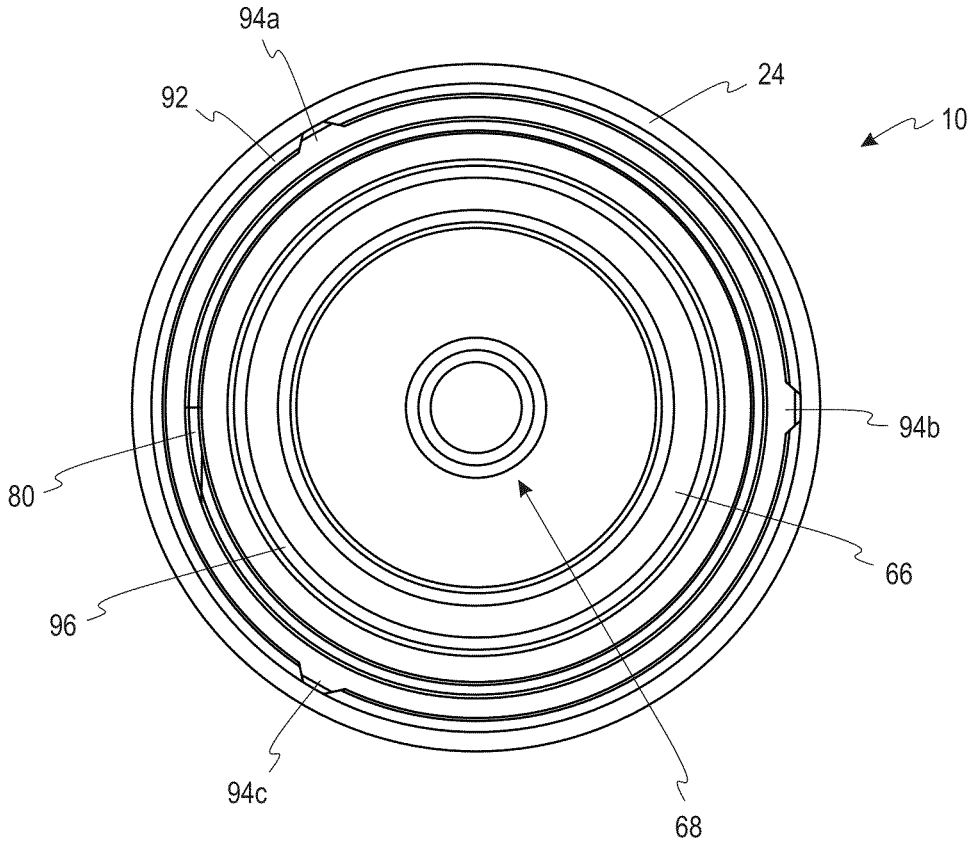
FIG. 3C is a bottom view of the polymeric closure assembly of FIG. 3A.

Referring to FIG. 3C, the polymeric inner shell 60 includes a sealing mechanism 96. The sealing mechanism is a continuous plug seal. The sealing mechanism 96 is configured to seal with the finish of the container 100. It is contemplated that a plurality of seals may be used such a continuous plug seal and an outer seal. It is contemplated that other sealing mechanisms may be used in the polymeric closure assembly.

The polymeric closure assemblies may include an oxygen-scavenger material. This oxygen-scavenger material may be distributed within the polymeric closure assemblies may be a separate layer. The oxygen-scavenger material may be any material that assists in removing oxygen within the container, while having little or no effect on the contents within the container.

Alternatively, or in addition to, the polymeric closure assemblies may include an oxygen-barrier material. The oxygen-barrier material may be added as a separate layer or may be integrated within the closure itself. The oxygen-barrier materials assist in preventing or inhibiting oxygen from entering the container through the polymeric closure assemblies. These materials may include, but are not limited to, ethylene vinyl alcohol (EVOH). It is contemplated that other oxygen-barrier materials may be used in the polymeric closure assemblies.

As discussed above, the polymeric container assembly 10 is used with the container 100 to form the package 200. The container has a neck portion defining an opening. The neck portion has an exterior surface and an interior surface. The container has an external thread formation on the neck portion.

Referring to FIG. 5, the container 100 is shown that includes a neck portion 102 defining an opening 106. The opening 106 is located opposite of a bottom 104 of the container. The container 100 includes a continuous side wall 108 that extends from the bottom 104 to the neck portion 102. The neck portion 102 of the container 100 includes an external thread formation 110 and an A-collar 114 to assist in manufacturing and movement of the container.

In one embodiment, a package comprises a container and a polymeric closure assembly. The container has a neck portion defining an opening. The neck portion has an exterior surface and an interior surface. The container has an external thread formation on the neck portion. The polymeric closure assemblies is configured for fitment to the neck portion of the container for closing the opening. The polymeric closure assemblies are configured to be placed on containers or bottles that contain product. The product may be a liquid product, but also may be a solid product or a combination of a liquid and solid product.

One non-limiting example of a polymeric closure assembly and a container forming a package is shown in FIGS. 6A, 6B. FIG. 6A is a top perspective view of the package 200 including the polymeric closure assembly 10 of FIGS. 3A, 3B and the container 100 of FIG. 5. FIG. 6B is a side perspective view of the package 200 including the polymeric closure assembly 10 of FIGS. 3A, 3B and the container 100 of FIG. 5. FIGS. 6A, 6B shows the package 200 in an unopened position or state.

The outer shell portion 20 and the inner shell portion 60 are made of polymeric material. The outer shell portion 20 and the inner shell portion 60 are typically made of an olefin (e.g., polyethylene (PE), polypropylene (PP)), polyethylene terephthalate (PET) or blends thereof. One example of a polyethylene that may be used is high density polyethylene (HDPE). It is contemplated that the outer shell portion and the inner shell portion may be made of other polymeric materials.

The polymeric closure assemblies are typically formed by molding processes such as injection molding. It is contemplated that other processes may be used in forming the polymeric closure assemblies of the present invention.

The container 100 is typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. It is also contemplated that the container may be formed of glass. The container 100 is typically have an encapsulated oxygen-barrier layer or oxygen barrier material incorporated therein.

In one method of manufacturing the package, a closure assembly and a container are initially provided. A non-limiting example of a polymeric closure assembly is the polymeric closure assembly 10 and the container 100 discussed above. The polymeric closure assembly 10 is threaded onto the container 100.

To open the polymeric closure assembly 10, a user rotates the polymeric outer shell 20 in a counterclockwise direction, while simultaneously pushing down with axial force (in the direction of arrow B in FIGS. 4A, 4B). To close the polymeric closure assembly 10, a user rotates the polymeric outer shell 20 in a clockwise direction. It is contemplated that the polymeric closure assembly may be configured to be opened in a clockwise direction and closed in a counterclockwise direction.

The polymeric closure assemblies are desirable in both low-temperature and high-temperature applications. The polymeric closure assemblies may be used in low-temperature applications such as an ambient or a cold fill. These applications include water, sports drinks, aseptic applications such as dairy products, and pressurized products such as carbonated soft drinks. It is contemplated that other low-temperature applications may be used with the polymeric closures.

The polymeric closure assemblies may be exposed to high-temperature applications such as hot-fill, pasteurization, and retort applications. A hot fill application is generally performed at temperatures around 185° F., while a hot fill with pasteurization is generally performed at temperatures around 205° F. Retort applications are typically done at temperatures greater than 244° F. It is contemplated that the polymeric closure assemblies can be used in other high-temperature applications.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A polymeric closure assembly comprising:

a polymeric inner shell including a polymeric top wall portion and a polymeric annular skirt portion, the polymeric annular skirt portion of the inner shell depending from the polymeric top wall portion of the inner shell, the polymeric top wall portion of the inner shell including an exterior surface and an interior surface, the exterior surface of the polymeric top wall portion of the inner shell forming a recess and including a plurality of ratchet teeth, the polymeric annular skirt portion of the inner shell including an exterior surface and an interior surface, the interior surface of the polymeric annular skirt portion of the inner shell including a thread formation for mating engagement with a thread formation of a container; and a polymeric outer shell including a polymeric top wall portion and a polymeric annular skirt portion, the polymeric annular skirt portion of the outer shell depending from the polymeric top wall portion of the outer shell, the polymeric top wall portion of the outer shell including an inner portion and an outer portion, the outer portion of the outer shell being detachably connected to the inner portion of the outer shell by a plurality of frangible connections, the inner portion of the polymeric top wall portion of the outer shell including an exterior surface and an interior surface, the interior surface of the inner portion of the polymeric top wall portion of the outer shell including a retention projection and a plurality of ratchet teeth, wherein the retention projection is configured to be received and contained within the recess formed in the inner shell to assist in engaging the inner and outer shells after breaking of the plurality of frangible connections, wherein the plurality of ratchet teeth of the inner shell and the plurality of ratchet teeth of the outer shell cooperate to assist in providing torque transfer to assist in threading the polymeric closure assembly and the container, wherein the recess formed in the polymeric top wall portion of the inner shell includes a continuous annular ring, the continuous annular ring assisting in containing the retention projection within the recess formed in the polymeric top wall portion of the inner shell after breaking of the plurality of frangible connections.

2. The closure assembly of claim 1, wherein the retention projection includes a plurality of deflectable portions, the plurality of deflectable portions and the continuous annular ring assisting in containing the inner portion of the outer shell within the recess after breaking of the plurality of frangible connections.

3. The closure assembly of claim 1, wherein the thread formation of the inner shell is an internal thread formation for mating engagement with an external thread formation of a container.

4. The closure assembly of claim 1, wherein the interior surface of the polymeric top wall portion of the outer shell includes a plurality of torque-transfer ribs, wherein the exterior surface of the polymeric top wall portion of the inner shell includes a plurality of torque-transfer extending projections, the plurality of torque-transfer ribs and the plurality of torque-transfer extending projections cooperating to form a child-resistant feature by preventing or inhibiting opening of the container by only rotational movement.

5. The closure assembly of claim 4, wherein each of the plurality of torque-transfer extending projections has a generally straight side and an opposing ramped side.

6. The closure assembly of claim 1, wherein the outer portion of the outer shell includes a spacer ring, the spacer ring connecting with the inner portion of the outer shell via the plurality of frangible connections.

7. The closure assembly of claim 1, wherein the inner portion of the outer shell is an inner ring, and wherein the outer portion of the outer shell is an outer ring.

8. A polymeric closure assembly comprising:

a polymeric inner shell including a polymeric top wall portion and a polymeric annular skirt portion, the polymeric annular skirt portion of the inner shell depending from the polymeric top wall portion of the inner shell, the polymeric top wall portion of the inner shell including an exterior surface and an interior surface, the exterior surface of the polymeric top wall portion of the inner shell forming a recess and including a plurality of ratchet teeth, the polymeric annular skirt portion of the inner shell including an exterior surface and an interior surface, the interior surface of the polymeric annular skirt portion of the inner shell including a thread formation for mating engagement with a thread formation of a container; and a polymeric outer shell including a polymeric top wall portion and a polymeric annular skirt portion, the polymeric annular skirt portion of the outer shell depending from the polymeric top wall portion of the outer shell, the polymeric top wall portion of the outer shell including an inner portion and an outer portion, the outer portion of the outer shell being detachably connected to the inner portion of the outer shell by a plurality of frangible connections, the inner portion of the polymeric top wall portion of the outer shell including an exterior surface and an interior surface, the interior surface of the inner portion of the polymeric top wall portion of the outer shell including a retention projection and a plurality of ratchet teeth, wherein the retention projection is configured to be received and contained within the recess formed in the inner shell to assist in engaging the inner and outer shells after breaking of the plurality of frangible connections, wherein the plurality of ratchet teeth of the inner shell and the plurality of ratchet teeth of the outer shell cooperate to assist in providing torque transfer to assist in threading the polymeric closure assembly and the container, wherein the inner portion of the outer shell is recessed relative to the outer portion of the outer shell.

9. The closure assembly of claim 1, wherein each of the ratchet teeth of the outer shell increases thickness from one end to a second end and forms a ramp, and wherein each of the ratchet teeth of the inner shell increases in thickness from one end to a second end and forms a ramp.

10. The closure assembly of claim 1, wherein the inner shell has an inner portion and an outer portion separated by a continuous annular channel formed therebetween, the continuous annular channel configured to receive a section of the outer portion of the outer shell after the plurality of frangible connections is broken.

11. The closure assembly of claim 1, wherein the polymeric annular skirt portion of the outer shell includes an inwardly annular retention ring at a bottom thereof to assist in retaining the inner and outer shells together.

12. The closure assembly of claim 1, wherein the outer shell further includes a centering ring, the centering ring extending inwardly from an interior surface of the polymeric annular skirt portion of the outer shell.

13. A package comprising:

a container having a neck portion defining an opening, the neck portion having an exterior surface and an interior surface, the container having a thread formation being located on the exterior surface of the neck portion; and a polymeric closure assembly configured for fitment to the neck portion of the container, the polymeric closure assembly including a polymeric inner shell and a polymeric outer shell, the polymeric inner shell including a polymeric top wall portion and a polymeric annular skirt portion, the polymeric annular skirt portion of the inner shell depending from the polymeric top wall portion of the inner shell, the polymeric top wall portion of the inner shell including an exterior surface and an interior surface, the exterior surface of the polymeric top wall portion of the inner shell forming a recess and including a plurality of ratchet teeth, the polymeric annular skirt portion of the inner shell including an exterior surface and an interior surface, the interior surface of the polymeric annular skirt portion of the inner shell including a thread formation for mating engagement with the thread formation of the container, the polymeric outer shell including a polymeric top wall portion and a polymeric annular skirt portion, the polymeric annular skirt portion of the outer shell depending from the polymeric top wall portion of the outer shell, the polymeric top wall portion of the outer shell including an inner portion and an outer portion, the outer portion of the outer shell being detachably connected to the inner portion of the outer shell by a plurality of frangible connections, the inner portion of the polymeric top wall portion of the outer shell including an exterior surface and an interior surface, the interior surface of the inner portion of the polymeric top wall portion of the outer shell including a retention projection and a plurality of ratchet teeth, wherein the retention projection is configured to be received and contained within the recess formed in the inner shell to assist in engaging the inner and outer shells after breaking of the plurality of frangible connections, wherein the plurality of ratchet teeth of the inner shell and the plurality of ratchet teeth of the outer shell cooperate to assist in providing torque transfer to assist in threading the polymeric closure assembly and the container, wherein the recess formed in the polymeric top wall portion of the inner shell includes a continuous annular ring, the continuous annular ring assisting in containing the retention portion within the recess formed in the polymeric top wall portion of the inner shell after breaking of the plurality of frangible connections.

14. The package of claim 13, wherein the interior surface of the polymeric top wall portion of the outer shell includes a plurality of torque-transfer ribs, wherein the exterior surface of the polymeric top wall portion of the inner shell includes a plurality of torque-transfer extending projections, the plurality of torque-transfer ribs and the plurality of torque-transfer extending projections cooperating to form a child-resistant feature by preventing or inhibiting opening of the container by only rotational movement.

15. The package of claim 13, wherein the outer portion of the outer shell includes a spacer ring, the spacer ring connecting with the inner portion of the outer shell via the plurality of frangible connections.

16. A package comprising:

a container having a neck portion defining an opening, the neck portion having an exterior surface and an interior surface, the container having a thread formation being located on the exterior surface of the neck portion; and a polymeric closure assembly configured for fitment to the neck portion of the container, the polymeric closure assembly including a polymeric inner shell and a polymeric outer shell, the polymeric inner shell including a polymeric top wall portion and a polymeric annular skirt portion, the polymeric annular skirt portion of the inner shell depending from the polymeric top wall portion of the inner shell, the polymeric top wall portion of the inner shell including an exterior surface and an interior surface, the exterior surface of the polymeric top wall portion of the inner shell forming a recess and including a plurality of ratchet teeth, the polymeric annular skirt portion of the inner shell including an exterior surface and an interior surface, the interior surface of the polymeric annular skirt portion of the inner shell including a thread formation for mating engagement with the thread formation of the container, the polymeric outer shell including a polymeric top wall portion and a polymeric annular skirt portion, the polymeric annular skirt portion of the outer shell depending from the polymeric top wall portion of the outer shell, the polymeric top wall portion of the outer shell including an inner portion and an outer portion, the outer portion of the outer shell being detachably connected to the inner portion of the outer shell by a plurality of frangible connections, the inner portion of the polymeric top wall portion of the outer shell including an exterior surface and an interior surface, the interior surface of the inner portion of the polymeric top wall portion of the outer shell including a retention projection and a plurality of ratchet teeth, wherein the retention projection is configured to be received and contained within the recess formed in the inner shell to assist in engaging the inner and outer shells after breaking of the plurality of frangible connections, wherein the plurality of ratchet teeth of the inner shell and the plurality of ratchet teeth of the outer shell cooperate to assist in providing torque transfer to assist in threading the polymeric closure assembly and the container, wherein the inner portion of the outer shell is recessed relative to the outer portion of the outer shell.

17. The package of claim 13, wherein each of the ratchet teeth of the outer shell increases thickness from one end to a second end and forms a ramp, and wherein each of the ratchet teeth of the inner shell increases in thickness from one end to a second end and forms a ramp.

18. The package of claim 13, wherein the inner shell has an inner portion and an outer portion separated by a continuous annular channel formed therebetween, the continuous annular channel configured to receive a section of the outer portion of the outer shell after the plurality of frangible connections is broken.

19. The closure assembly of claim 1, wherein the inner portion of the outer shell is recessed relative to the outer portion of the outer shell.

20. The package of claim 13, wherein the inner portion of the outer shell is recessed relative to the outer portion of the outer shell.

* * * * *